United States Patent [19]

Allen

[11] Patent Number: 4,845,844

[45] Date of Patent: Jul. 11, 1989

[54] FOIL CUTTER

[75] Inventor: Herbert Allen, Houston, Tex.

[73] Assignee: Hallen Company, Houston, Tex.

[21] Appl. No.: 238,988

[22] Filed: Aug. 24, 1988

Related U.S. Application Data

[63] Continuation of Ser. No. 790,263, Oct. 22, 1985, abandoned.

[51] Int. Cl.[4] ..... B67B 7/00

[52] U.S. Cl. ..... 30/1.5; 30/102

[58] Field of Search ..... 30/1.5, 101, 102, 253; 7/156

[56] References Cited

U.S. PATENT DOCUMENTS

| | | | |
|---|---|---|---|
| D. 142,202 | 8/1945 | Lanyon | 30/1.5 |
| 896,303 | 8/1908 | Klepper | 30/1.5 |
| 996,433 | 6/1911 | Stone | 30/1.5 |
| 999,668 | 8/1911 | Montaperto | 30/102 |
| 1,102,124 | 6/1914 | Baptiste | 30/1.5 |
| 1,531,903 | 3/1925 | Cummins | 30/253 X |
| 2,439,894 | 4/1948 | Jahn et al. | 30/1.5 |
| 2,503,517 | 4/1950 | Sirica . | |
| 2,566,653 | 9/1951 | Callahan | 30/1.5 |
| 2,589,742 | 3/1952 | Smith | 30/2 |
| 2,681,504 | 6/1954 | Fox . | |
| 2,694,854 | 11/1954 | Kannenberg | 30/1.5 |
| 2,718,692 | 9/1955 | Krzanowski | 30/1.5 |
| 2,823,395 | 2/1958 | Brownson | 30/1.5 X |
| 3,025,597 | 3/1962 | Huglin | 30/102 X |

FOREIGN PATENT DOCUMENTS

| | | | |
|---|---|---|---|
| 839319 | 3/1952 | Fed. Rep. of Germany | 30/1.5 |
| 1097917 | 2/1955 | France | 30/1.5 |
| 15940 | of 1889 | United Kingdom | 30/1.5 |

*Primary Examiner*—Douglas D. Watts

*Attorney, Agent, or Firm*—Browning, Bushman, Zambecki & Anderson

[57] ABSTRACT

A cutting device for cutting material covering wine bottle necks comprising cutters defining at least three cutting surfaces and a frame carrying the cutters. The frame has an axis and positions the cutters such that the cutting surfaces are radially spaced from the axis, aligned transversely in the axis and circumferentially spread with the angular displacement between each cutting surface and the two adjacent cutting surfaces less than 180°, whereby, upon rotation of the frame about the axis by an amount less than 180°, the cutting surfaces respectively define contiguous arcs of a common circle. The frame further permits the cutting surfaces to so define a plurality of such common circles of different diameters.

31 Claims, 5 Drawing Sheets

FIG. 1
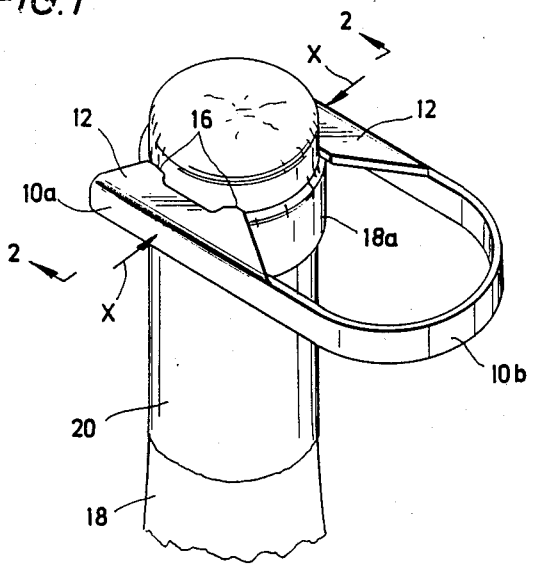
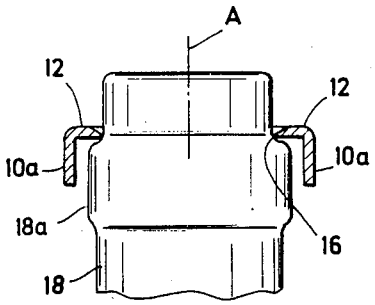
FIG. 2
FIG. 3
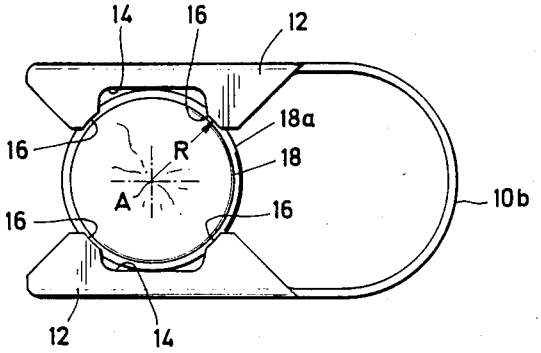
FIG. 4
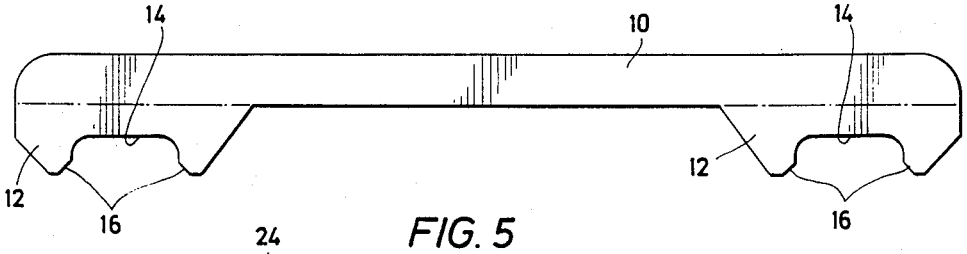
FIG. 5
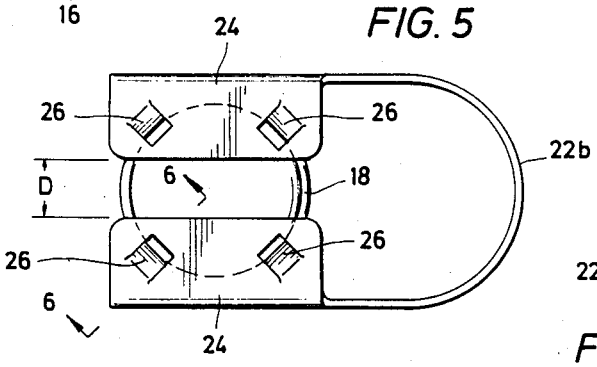
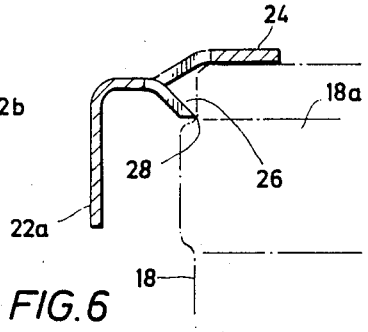
FIG. 6

FIG. 7
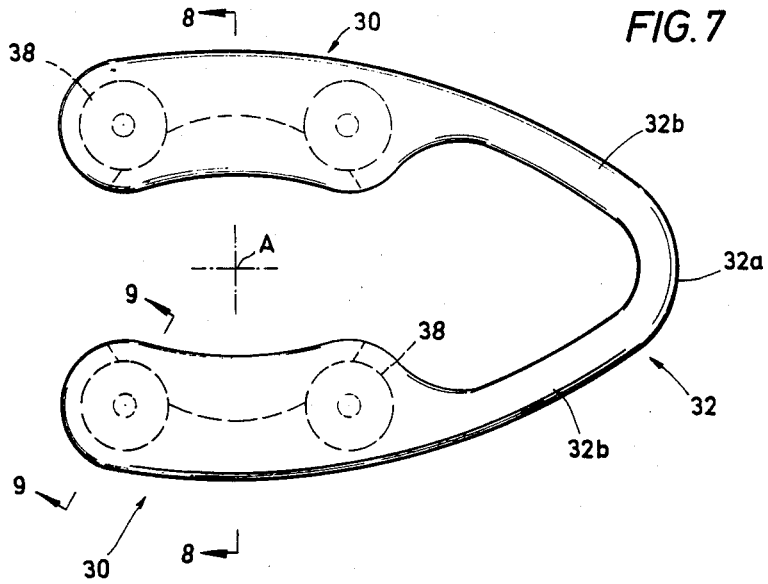
FIG. 8
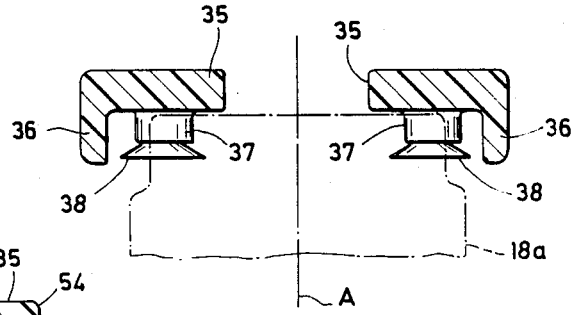
FIG. 9
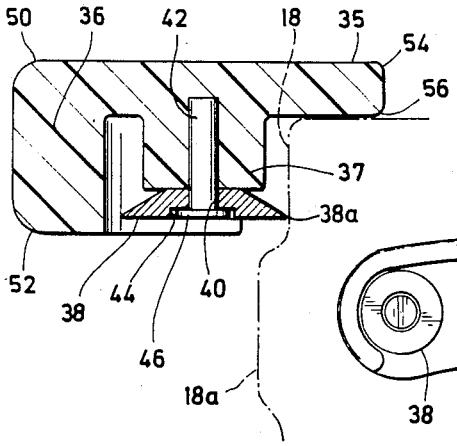
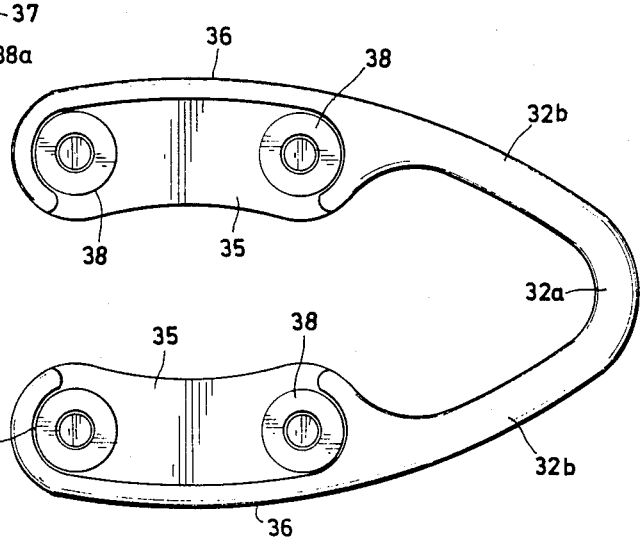
FIG. 10

FIG. 14
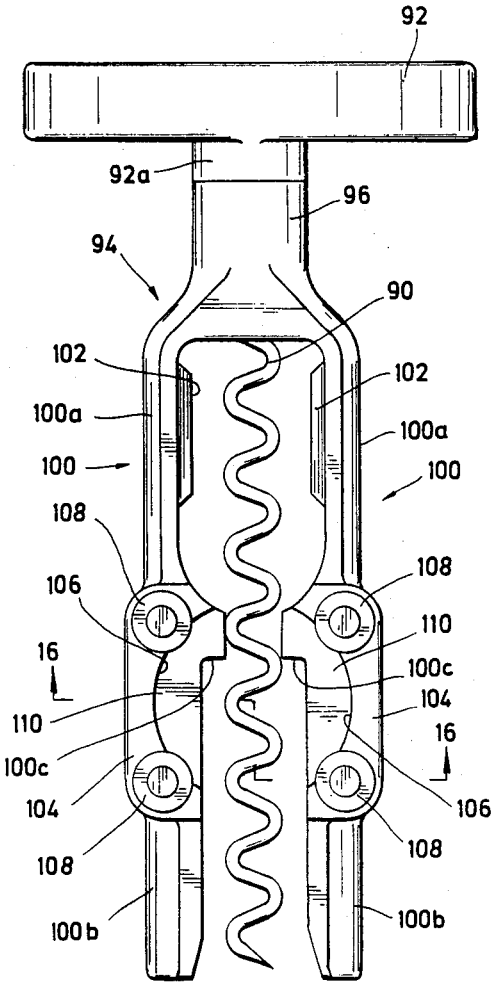
FIG. 15
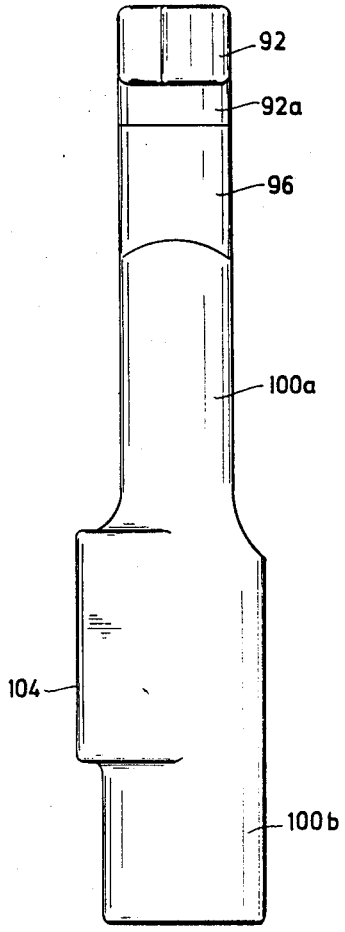
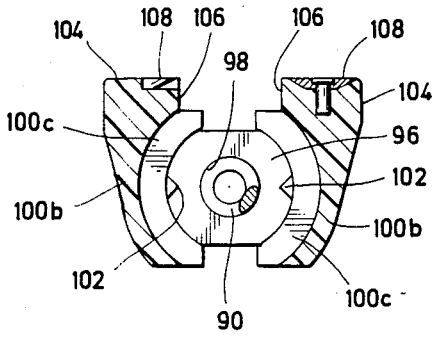
FIG. 16

FIG. 17
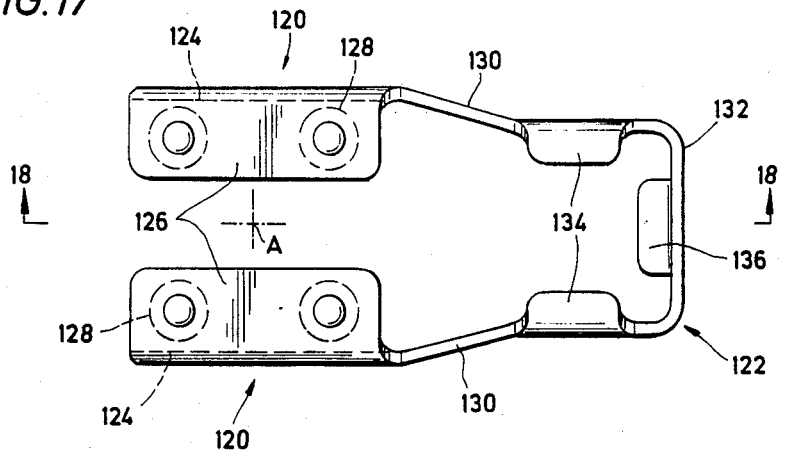
FIG. 18
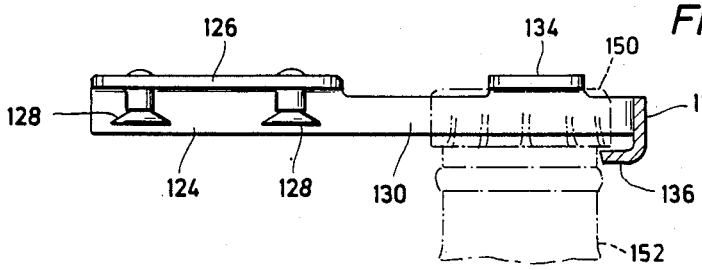
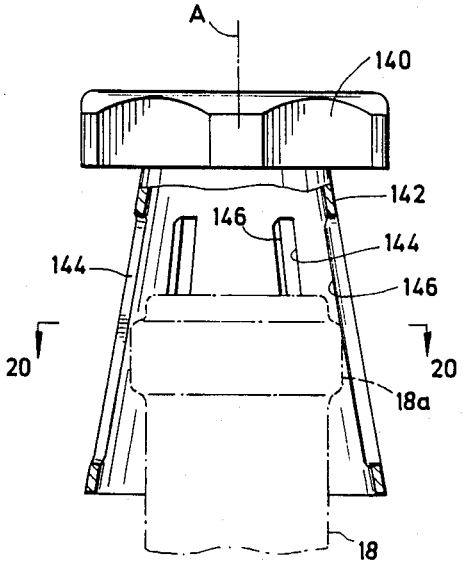
FIG. 19
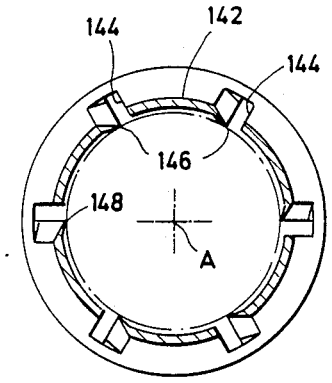
FIG. 20

FOIL CUTTER

This is a continuation of co-pending application Ser. No. 790,263 filed on Oct. 22, 1985.

BACKGROUND OF THE INVENTION

1. Field of the Invention

The present invention relates generally to a cutting device for removing a portion of the metallic foil or plastic material covering the upper portion of a wine bottle neck prior to removal of the cork from the neck of the bottle.

2. Description of the Background

In the wine bottling industry, it is common practice to cover the top and the upper part of the neck of a bottle with a sheath made of metallic foil or plastic material after a cork has been placed in the bottle. It has become customary, particularly when serving wine on "special occasions," in restaurants, at banquets, or whenever a certain degree of elegance and finesse is called for, to remove a small circlet of this material from the top of the bottle neck to provide a clean opening through which the cork can be extracted while leaving the remainder of the sheath in place on the bottle neck to provide what has come to be considered a proper or appealing appearance.

As a practical matter, it is sometimes possible, with the aid of a corkscrew, to extract a cork from such a bottle by pulling the cork through the foil. However, this approach leaves a rough or jagged edge of such material around the opening left by the cork. The jagged edge is considered aesthetically undesirable and may cause the pouring of the wine to become a rather messy operation. It is also possible, particularly where the outer sheath or covering is made of a thin metallic foil, to completely remove this material from the bottle before uncorking. However, this is likewise awkward and time consuming, and as mentioned, it has come to be considered as detracting from the aesthetic appearance of the bottle. In short, the removal of a small circlet of foil from the top of the bottle, while leaving the remainder of the foil in place on the bottle neck, has become a ritual with which every good waiter is expected to comply, and many ordinary consumers seek to emulate in their homes.

In most instances, this task is now performed with an ordinary straight blade knife, which is often built into the waiter's style corkscrew. It takes considerable practice to be able to perform the task quickly and deftly with such a knife, and even for one of considerable skill, it is time consuming, and the knife will sometimes slip.

A number of devices have been devised for severing the sealing material which overlies the caps of bottles of the type used for hard spirits. It would appear that none of these devices has attained widespread use for that purpose, and, based on analyses of the designs of these devices, one can reasonably surmise that, for one reason or another, they simply proved to be more trouble than the worth.

If these devices have been little used for their own intended purpose, they are much less suited for cutting the foil sheath of a wine bottle, due to differences in the forms of wine bottles and hard spirit bottles and closures therefor. For example, hard spirit bottles are typically closed either with a screw-on cap or with a stopper the upper end of which is enlarged to overly the top of the bottle. In either case, a crevice is defined at the lower edge of the cap or stopper top, and this provides easy guidance for a blade or the like. Such is not the case with wine bottles, wherein the cork is disposed entirely within the bottle. The materials which are used to envelop or cover the upper portions of wine bottles also typically differ substantially from those used to cover or seal hard liquor bottles.

Thus, one can appreciate at least some of the factors which make these devices undesirable, even for their own proper purpose, and even more unsuitable for the purpose of the present invention. For example, U.S. Pat. No. 2,589,742 to Smith and U.S. Pat. No. DES 142,202 to Lanyon disclose rigid, integral, double blade knives. These would be difficult to properly position and guide on a wine bottle, as opposed to a liquor bottle, and in any event, are ergonomically awkward in that they require the application of radial force with the entire hand positioned to one side of the bottle neck, in combination with a turning movement of over 180°.

U.S. Pat. No. 2,722,736 to Svalgard, No. 2,276,268 to Donlon, No. 2,271,308 to Ross, and No. 2,439,894 to Jahn et al all disclose devices which likewise require well over 180°, and in some cases a full 360°, of turning motion. Furthermore, each of these devices is spring biased to a configuration designed to tightly engage the bottle neck, so that it must be snapped onto the bottle neck or bottle cap for use.

Other such devices, e.g. those shown in U.S. Pat. No. 2,497,388 to Zuba, U.K. Patent No. 15,940 to Chennel, and U.S. Pat. No. 2,823,395 to Brownson, operate on a scissors-like principle either to cut liquor bottle seals or wires. Two of these are freely pivotable, while the other is spring loaded to a closed position like the last mentioned group of devices. Although the blades may be curved, such a device provides only two point cutting contact, except—at most—on one given size bottle. Thus, as a practical matter, they require at least 180° rotary movement. They are also inconvenient in that they must be actively opened for positioning on the bottle.

One prior patent, French Patent No. 1.097.917, purports to disclose a device specifically designed for cutting the foil wrappers of wine bottles. However, this device suffers from some of the same disadvantages of the liquor bottle knives discussed above. Both disclosed embodiments are unsuitable from an ergonomic standpoint; they require the application of force with the hand in an uncomfortable or unnatural position, along with more than 180° rotary motion.

Still other cutting devices are known, for even less analogous purposes, such as those disclosed in U.S. Pat. No. 2,681,504, for stripping and cutting flower stems, and U.S. Pat. No. 3,036,611 for cutting shelled eggs. These devices have opposite blades, which are non-aligned, so that, as they are urged toward each other, they will overlap to cut completely through a body (such as the flower stem or egg) with a shearing type action. Ignoring, momentarily, the ergonomic and other problems these devices might entail even when utilized for their own respective purposes, they are completely non-analogous to and unsuitable for the specialized purpose of removing circlets of foil from wine bottles.

SUMMARY OF THE INVENTION

In the description of the invention set forth below, the material that covers the neck of the bottle will be referred to as metallic foil, it being understood that other types of nonmetallic material, such as plastic, may be used for such a covering or sheath. The present invention may be used in cutting through either metallic or non-metallic types of wine bottle neck sheaths.

The present invention provides a cutting device which is specially adapted for the particular purpose of removing a small circlet of foil adjacent the upper end of a wine bottle, and which device is ergonomically designed for the comfort, safety, and efficiency of the user.

In one of its broader aspects, the device includes cutting means, defining at least three cutting edges or other surfaces, and a frame having an axis, which in use, will coincide generally with the longitudinal centerline of the wine bottle The frame carries the cutting means and positions them such that their cutting surfaces are radially spaced from the axis, aligned transversely of the axis, and circumferentially spread with the angular displacement between each cutting surface and the two adjacent cutting surfaces less than 180°. Thereby, upon rotation of the frame about the axis by an amount less than 180°, the cutting surfaces respectively define contiguous arcs of a common circle. In other words, when the cutting surfaces are engaged with the foil, and the device is rotated about its axis, the cuts made in the foil by the respective cutting surfaces will, before the device has been rotated 180°, intersect to form a complete circular cut severing the circlet of foil which overlies the top of the wine bottle. Furthermore, the frame is adapted to permit the cutting surfaces to so define a plurality of such circles of different diameters so that the device can operate on various sizes of bottle necks.

One of the main advantages of the invention is the provision of multiple transversely aligned cutting surfaces whereby the full circlet of foil can be cut with only a relatively small rotary movement This greatly enhances the ergonomics of the device, in terms of efficiency, user comfort, and ease of operation. In preferred embodiments, the cutting surfaces are generally equally circumferentially spaced, so that minimum rotation is required. Furthermore, in preferred embodiments, there are four or more such surfaces, so that the rotary motion required is more or less a slight twisting of the device.

In a number of the preferred embodiments, the frame comprises first and second force application members having opposed inner sides adapted for disposition on opposite sides of a wine bottle neck. Each of the two force application members carries cutting means on its inner side. The frame also includes a resiliently flexible connector which interconnects the force application members and has an unflexed position wherein they are spaced apart. The spacing of the force application members, and the cutting means carried thereby, with the connector in its unflexed position, is such that the cutting surfaces will easily clear the necks of the more common sizes of wine bottles. Thus, the device can easily be slipped downward over the top of the bottle so that the cutting surfaces lie in a suitable position, shortly below the bottle top, whereafter the flexibility of the connector allows the force application members to be urged inwardly toward each other to bring the cutting surfaces into engagement with the bottle. However, the connector also permits the force application members to be urged outwardly away from each other so that the device can also be used on the less common, larger sizes of wine bottles.

It has been found, somewhat surprisingly, that this scheme, wherein the opposed force application members are usually urged inwardly against the resilient bias is preferable to any of the older liquor bottle knife schemes involving, respectively, fixed blades, blades biased inwardly to a closed position, or freely pivoted blades. This scheme generally provides greater user comfort, efficiency, and ease of operation. Nevertheless, the device is virtually universally applicable, even to rare large bottles.

It is particularly helpful that, in using the present device on standard size bottles, minimum user action is needed to place the force application members on opposite sides of the bottle neck, because they are normally biased apart. Furthermore, the ergonomics of the device are greatly enhanced by the fact that the user, with thumb on the outer surface of one of the force application members and one or more fingers on the outer surface of the other force application member, can apply the radial force needed to overcome the resilient bias and bring the cutting means into engagement with the foil by a simple, comfortable, and natural squeezing action similar to simply closing his hand, thereby applying such radial force on generally opposite sides of the bottle neck. The slight resistance to such squeezing action offered by the resilient bias actually makes the device more comfortable and easy to use than a freely pivoted scheme.

The comfort and ease of this action are enhanced in preferred embodiments in which the connector extends generally laterally from the force application members allowing the user's hand to rest in a comfortable, generally palm down position. Preferably, the connector is generally U-shaped, and indeed the device as a whole is generally U-shaped, the force application members forming continuations of the free ends of the arms of the U-shaped connector. Thus, the connector may rest naturally and comfortably generally in the user's palm, particularly if the arms of the U-shaped connector are tapered inwardly somewhat toward the base thereof.

In a particularly unique embodiment of the invention, the cutting device is incorporated in a cork extractor device of the type generally disclosed in U.S. Pat. No. 4,291,597 and No. 4,377,096. To the extent that it may be helpful to an understanding of the present invention, the specifications of U.S. Pat. No. 4,291,597 and No. 4,377,096 are hereby incorporated by reference.

In another embodiment, the device is substantially rigid, the cutting means comprising a plurality of generally longitudinally extending, circumferentially spaced blades flared radially outwardly from their upper ends to their lower ends. More specifically, the frame comprises a generally frustoconical sleeve, the blades being formed from and projecting radially inwardly from the sleeve, and a handle disposed transversely across the upper end of the sleeve. This device, although substantially rigid, is likewise adaptable to virtually any size bottle due to its generally frustoconical shape. Specifically, the device is simply lowered over the top of the bottle until, at some point along the length of the tapered blades, the blade edges will come to rest upon the upper corner of the bottle. Then, utilizing only a slight downward force to hold the device in place, the user simply twists the device to cut a circlet of foil from the top of the bottle.

It is a primary object of the present invention to provide a simple and effective cutting device for cutting the material that covers a wine bottle neck.

It is a further object of the present invention to provide such a device for cutting and removing a small circlet of the material to completely expose the top of the cork that is in the bottle while leaving the remainder of the material intact along the upper portion of the bottle neck.

It is a further object of the present invention to provide such a cutting device that can be operated by hand with a minimum of time and effort.

Still another object of the present invention is to provide such a cutting device which is ergonomically designed.

Another object of the present invention is to provide such a device which can be used on various sizes of bottle necks.

Yet a further object of the present invention is to provide such a cutting device which may be incorporated in the bottle gripping portion of a corkscrew guide frame or holder.

Still other objects, features and advantages of the present invention will be made apparent by the following detailed description, the drawings and the claims.

BRIEF DESCRIPTION OF THE DRAWINGS

FIG. 1 is a perspective view of a first embodiment of the invention in cutting position on a wine bottle neck.

FIG. 2 is a transverse cross-sectional view taken on the line 2—2 in FIG. 1.

FIG. 3 is a top plan view of the device of FIG. 1 in unflexed position.

FIG. 4 is a plan view of a metal stamping from which the device of FIG. 1 can be formed.

FIG. 5 is a top plan view of a second embodiment of the invention.

FIG. 6 is an enlarged detailed sectional view taken on the line 6—6 in FIG. 5.

FIG. 7 is a top plan view of a third embodiment of the invention.

FIG. 8 is a transverse cross-sectional view taken on the line 8—8 of FIG. 7.

FIG. 9 is an enlarged detailed sectional view taken on the line 9—9 of FIG. 7.

FIG. 10 is a bottom plan view of the device of FIG. 7.

FIG. 14 is a front elevational view of a cork extractor incorporating a sixth embodiment of the present invention.

FIG. 15 is a side elevation view of the device of FIG. 14.

FIG. 16 is a cross-sectional view taken on the line 16—16 of FIG. 14.

FIG. 17 is a top plan view of a seventh embodiment of the present invention.

FIG. 18 is a sectional view taken on the line 18—18 of FIG. 17.

FIG. 19 is an elevation view of an eighth embodiment of the invention, with the skirt portion thereof broken away in longitudinal cross section.

FIG. 20 is a transverse cross-sectional view taken on the line 20—20 in FIG. 19.

DESCRIPTION OF THE PREFERRED EMBODIMENTS

Figure 11:
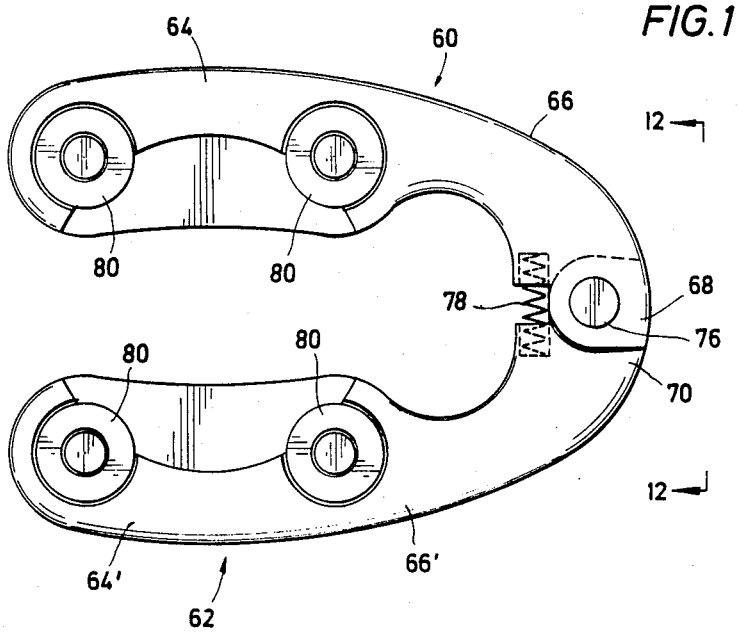
FIG. 11 is a bottom plan view of a fourth embodiment of the invention.

FIGS. 1–3 illustrate a first embodiment of the invention, and FIG. 4 illustrates a metal stamping or the like from which that embodiment can be formed. The embodiment of FIGS. 1–3 represents one of the simplest forms of the present invention.

Referring first to FIG. 4, the metal stamping from which the device is formed includes an elongate strip 10. At opposite ends of strip 10, and on one side thereof, are a pair of lateral extensions 12. Each of the lateral extensions 12 is elongated generally parallel to strip 10, and on its free lateral edge, i.e. distal strip 10, and intermediate its opposite ends, has a recessed or cutaway area 14. At the opposite ends of each recess 14 there are a pair of cutting surfaces 16 disposed angularly with respect to each other and to the length of the stamping generally. The orientation of the two edges 16 on a respective extension 12 is such that they face somewhat toward each other, for a purpose to be described more fully hereinafter. After stamping of metal plate in the configuration shown in FIG. 4, and either before or after the folding and bending operations to be described hereinafter, the surfaces 16 may be sharpened, by any suitable machining technique, to form sharp cutting edges.

The folding or bending, which as well known in the art may be done automatically by machine, bends extending portions 12 at right angles to strip 10 to form flanges and bends the portion of strip 10 intermediate extensions 12 into a generally U-shaped configuration, resulting in the cutting device of FIGS. 1–3. The completed cutting device thus comprises first and second force application members each of which includes a respective extension or flange 12 and the adjoining portion **10*a* of the original strip 10**.

The free edges of flanges 12, on which cutting surfaces or edges 16 are formed, are now opposed to each other, facing inwardly, and adapted for disposition on opposite sides of a wine bottle neck 18, as shown in the drawings. The intermediate, bent, U-shaped portion **10*b* of the original strip 10 serves as a connector interconnecting the two force application members 10*a*, 12**.

The innermost portions of flanges 12 which are sharpened to form edges 16 comprise the cutting means of the device, with edges 16 themselves forming the cutting surfaces. (The term "surface," as used in this context, should be broadly construed as including sharp edges or points, as well as broad surfaces which might be rendered capable of cutting foil, e.g. by roughening.) The remainder of the device, i.e. the remainders of flanges 12, the adjacent skirts **10*a*, and the connector 10*b*, together make up the frame of the device. This frame has an axis A which, in use, is generally coincident with the longitudinal centerline of a bottle, e.g. 18. The frame positions the cutting edges 16 such that they are radially spaced from the axis A, aligned transversely of the axis A (see FIG. 2), and circumferentially spread with the angular displacement between each cutting surface and the two adjacent cutting surfaces less than 180°. More specifically, in this case, there are four cutting edges 16**, generally circumferentially spaced at about 90°.

Thus, upon rotation of the frame about axis A about 90°, the cutting surfaces 16 respectively define contiguous arcs of a common circle. In practical application, this means that the surfaces 16 are sufficiently aligned so that the cuts they make in the foil intersect to form a full circle.

The connector 10*b* is resiliently flexible. This flexibility allows the surfaces 16 to define circles of different diameters, and thus, to be used on different size bottles. Connector 10*b* normally assumes an unflexed position in which the two force application members 10*a*, 12 are spaced from each other. Furthermore, the size and relative dispositions of the various parts of the device are chosen so that, in this unflexed position, the flanges 12 are spaced apart by a distance greater than that required for engagement of the cutting edges 16 with a bottle neck 18 of standard size just above the drip ring 18 (see FIG. 3).

As is well known in the art, wine bottles are made in several recognized sizes, according to volume. The most common size, referred to herein as a "standard" size bottle is denoted simply by the word "bottle." This size is the most common or popular. Other fairly common sizes are the "half bottle," whose name is self-descriptive, and the "magnum," whose volume is twice that of a standard "bottle." A relatively rare size is the "double magnum" or "Jeroboam," having a volume of four (4) standard bottles; and even more rare is a size equivalent to six (6) standard bottles, often denoted by the name "Rehoboam," and somewhat confusingly also as a "Jeroboam." There are even larger sizes which are quite rare. Although the dimensions of the necks of bottles in any given volumetric size category will vary, the majority of the bottles in any given size category will have neck diameters falling within a range which can be empirically determined.

In preferred embodiments of the present invention, when the U-shaped connector 10*b* is in its unflexed position, as shown in FIG. 3, the radial distance R between the axis A and each of the cutting surfaces 16 is approximately 0.6 inch. With this spacing, when the connector 10*b* is in its unflexed position, the cutting edges 16 will clear the neck of a standard "bottle" sized bottle 18 above its drip ring 18*a* so that the device can easily be lowered over the top of the bottle with the cutting edges generally surrounding the bottle neck, as shown in FIG. 3.

The device need not be actively opened to position it with respect to the bottle neck 18, nor need it be forcibly snapped over the bottle neck, as in the case of many prior devices designed for liquor bottles. Once properly positioned, the resilience of connector 10*b* allows the flanges 12 to be urged toward each other, as indicated in FIGS. 1 and 2, by applying forces in a radially inward direction to portions 10*a* as indicated by arrows X in FIG. 1, to engage edges 16 with the bottle neck. (As used herein, terms such as "radially," "longitudinally," "laterally," "tangentially," and "circumferentially" will refer to the locus of the bottle neck, when the device is properly positioned for use, with axis A coincident with the bottle centerline, unless otherwise indicated.)

Of course, the same will be true in the case of smaller size bottles, such as half bottles, except that the force application members 10*a*, 12 will be flexed inwardly somewhat more in order to bring the cutting edges 16 into engagement with the bottle neck. The preferred sizing specified above will further permit the device to slip fairly easily over the top of most magnum size bottles. The flexibility of connector 10*b* will allow any slight spreading necessary, and the configuration of the device eliminates any need for the user to actively spread the force application members apart manually, but on the contrary, the bottle will cam them or wedge them apart as the device is lowered thereover. The flexibility of connector 10*b* is sufficient to also allow spreading of the force application members 10*a*, 12 so that the device can even be used on Jeroboam, Rehoboam or larger size bottles.

It is particularly important to note that the device is designed for a natural fit in the user's hand, with the thumb abutting one of the portions 10*a*, and one or more of the fingers abutting the other of the portions 10*a*. The fact that the connector 10*b* extends laterally from the force application members 10*a*, 12, allows it to lie naturally in the user's palm, and the overall configuration and manner of gripping the device lend themselves to use in a comfortable palm down position.

As mentioned, no positive opening or snapping action is necessary to position the flanges 12 on opposite sides of most bottle necks, and once they are so positioned, a simple and natural squeezing action, very similar to simply closing the hand, brings the cutting edges 16 into engagement with the foil covering 20 on the bottle neck 18 and punctures it. Then, by a relatively small rotary motion, the user may cut the foil. With this embodiment, a total rotation of about 90° is required. This is most conveniently effected by twisting the device back and forth, about 45° each way from a starting position in which the wrist is straight. The aforementioned angular orientation of the cutting edges 16 places them nearly tangential to the respective points of the bottle neck 18 which they engage.

As best shown in FIG. 2, a standard bottle neck 18 has an enlarged diameter drip ring 18*a* near its upper end. The upper edge of this drip ring may be used to help position the cutting edges 16 at a suitable point, a short distance below the bottle top, so that most of the foil covering 20 will remain intact on the bottle neck 18.

FIGS. 5 and 6 illustrate a second embodiment of the invention, which likewise may be formed of a metal plate stamping, but which is designed to make proper longitudinal positioning of the device even easier by providing an abutment for the top of the bottle neck 18. As in the preceding embodiment, the metal stamping from which the device is formed will include an elongate strip, the outer portions 22*a* of which form parts of the opposed engagement members, and the intermediate portion 22*b* of which is bent to form the U-shaped connector. Extensions 24 adjoining portions 22*a* are bent inwardly to form the flanges of the force application members. However, these flanges are not recessed, so that when the force application members 22*a*, 24 are in their open position, as normally maintained by the resilient flexible connector 22*b*, and the device is lowered onto the bottle neck 18, the flanges 24 serve as lips which will come into abutment with the bottle top.

The cutting means are formed by four tabs 26, each of the flanges 24 having two such tabs punched therefrom. The punching of the tabs 26 deforms them downwardly by a distance such that, when the flanges 24 are abutting the top of the bottle neck 18, the cutting edges 28 will be positioned near the upper extremity of the drip ring 18*a*. To facilitate this spacing, without the need for unduly large tabs 26, the portions of flanges 24 designed to abut the bottle top in use may be deformed slightly upwardly, as shown in FIG. 6. All of this deformation can be performed automatically, by machine, along with the basic bending operations described hereinabove.

The operation of the device of FIGS. 5 and 6 is generally the same as that of the first embodiment, except for the abutment of flanges 24 with the bottle top. In particular, even though the innermost portions of flanges 24 form lips extending inwardly beyond tabs 26 to abut the bottle top, tabs 26 are still spaced apart enough to clear the bottle neck in the open position. In order to ensure that the inner portions of flanges 24 will abut the tops of standard size bottles, and preferably also half bottles, with the connector **22*b* in its unflexed position, the diametrical distance D between the two flanges 24** should be less than the diameter of most bottles, e.g. substantially less than the diameter of a typical half bottle, but large enough to permit flexing of the device. It has been found that a distance D of about 0.625 inch is suitable.

Both of the embodiments described thus far are advantageous in that they are quite simple and inexpensive to form. However, because they utilize fixed blade type cutting means, they do involve certain slight disadvantages. For example, because the cutting edges operate with a slicing action, they may become dulled in use. Additionally, and again due to the slicing action of these types of cutting means, the rotational movement the user makes in cutting the foil covering 20 may tend to cause that covering to rotate, making the cutting action more difficult. Although this does not represent a very great problem for most users, it can be obviated with a preferred device utilizing rolling cutters. Such a device is exemplified in the embodiment of FIGS. 7–10.

The embodiment of FIGS. 7–10 includes a monolithic frame, molded of a suitable thermoplastic resin, and including opposed force application members 30 joined by a resiliently flexible connector 32. Connector 32 is generally U-shaped, and the body 30, 32 as a whole is likewise generally U-shaped, members 30 forming continuations of the arms of the U-shaped connector 32. The action of connector 32 in positioning members 30 in an unflexed position, but allowing them to be urged inwardly or outwardly to engage the bottle neck 18, is generally the same as that described hereinabove for the metallic connectors **10*b* and 22*b*** of the foregoing embodiments.

Each of the force application members 30 has an outermost skirt 36, a flange or lip 35 extending inwardly from the upper extremity of the skirt 36, and a pair of thickened hub-like formations 37 extending downwardly from the underside of the lip 35 and circumferentially spaced with respect to the axis A of the device.

In each of the formations 37, there is mounted a rollertype cutter 38. More specifically, as best shown in FIG. 9, each roller 38 has a central, longitudinal bore 40 which receives a shaft 42 on which the roller 38 is freely rotatable. The lower end of bore 40 is counterbored at 44, and a flange 46, extending radially outwardly from the lower end of shaft 42, is disposed in counterbore 44 to support roller 38 on shaft 42. The upper end of shaft 42 is fixedly mounted in formation 37 in any suitable manner. The rollers 38 are sized to protrude radially inwardly beyond formations 37 for cutting engagement with the foil covering of bottle neck 18.

Lips 35 serve a function similar to lips 24 in the embodiment of FIGS. 5 and 6, namely that of abutting the top of the bottle neck 18 to aid the user in properly positioning the rollers 38 along the length of the bottle neck, and more specifically, a short distance below the top just above the drip ring **18*a***.

The use of the device of FIGS. 7–10 is generally the same as that of the device of FIGS. 5 and 6. However, due to the rolling action of the cutters 38, they need not be extremely sharp in order to perform satisfactorily. On the contrary, the edge **38*a*** of each roller may be somewhat dull or blunted.

Other features contribute to the ergonomic desirability of the device. As in the foregoing embodiments, the connector 32 extends generally laterally from the force application members 30 in use, maximizing the comfort of the user's hand. To make the connector 32 fit even more comfortably in the user's palm, its arms **32*b* are tapered inwardly somewhat toward its base 32*a*, and the base in turn is rounded or radiused, as shown in FIGS. 7 and 10. Also, as best shown in FIG. 8, outer corners 50 and 52 are radiused for the comfort of the user. Although unlikely to be engaged by the user, inner corners 54 and 56** are likewise radiused.

Figure 12:
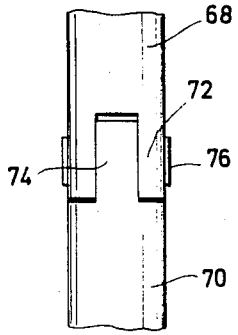
FIG. 12 is a detailed elevation view taken on the line 12—12 of FIG. 11.

FIGS. 11 and 12 show a third embodiment of the invention which is quite similar to that of FIGS. 7–10 except that the plastic body is formed in two parts 60 and 62. Part 60 includes one of the force application members 64, one arm 66 of the U-shaped connector, and a portion 68 of the base of the U-shaped connector. The other part 62 includes the other force application member 64', which is substantially identical to member 64, the other arm 66' of the U-shaped connector, and another portion 70 of the base of the U-shaped connector.

The two portions 68 and 70 of the base of the U-shaped connector are pivotally connected to each other. More specifically, portion 68 forms a clevis 72, and portion 70 forms a tongue 74 received in clevis 72 as shown in FIG. 12. The tongue 74 and clevis 72 are connected by a pivot pin 76, secured in the apparatus in any suitable manner as well known in the art. To bias the arms 66 and 66' away from each other, and thus hold the members 64 and 64' in an open position, a compression spring 78 is provided on the inner side of base 68, 70, the ends of the spring being received in respective recesses in the two parts 60 and 62. The force application members 64 and 64', including their rollers 80, are similar in form and function to members 30 and rollers 38 of the preceding embodiment.

Figure 13:
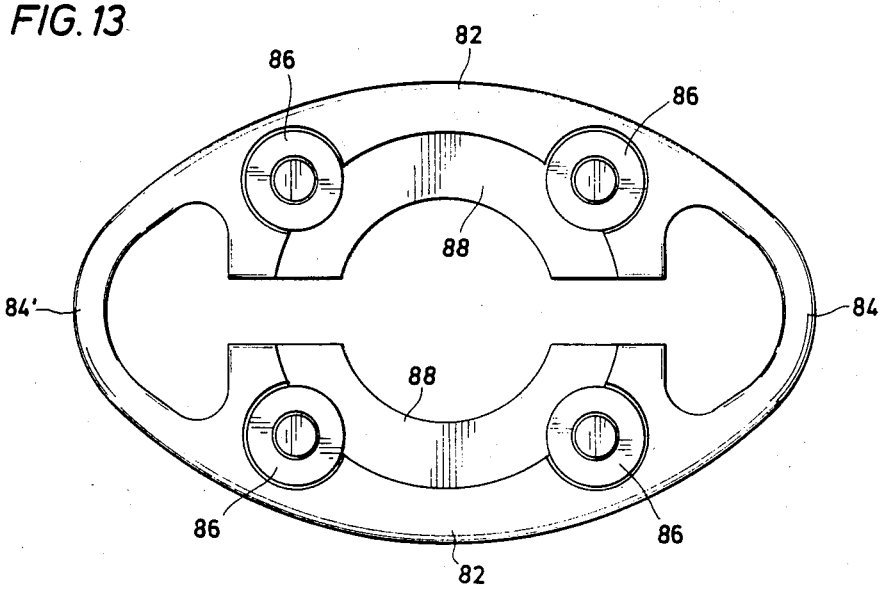
FIG. 13 is a bottom plan view of a fifth embodiment of the invention.

FIG. 13 shows still another embodiment of the invention in which opposed force application members 82 have one opposed pair of their respective ends connected by a first U-shaped connector 84 and the other opposed pair of adjacent ends connected by a second U-shaped connector 84', so that the body of the device as a whole is generally oval shaped. This expedient ensures that the rollers 86 which form the cutting means are perfectly symmetrically spaced and that the forces they apply to the foil in use are substantially equal. Otherwise, the form and function of the device is largely the same as that of the embodiment of FIGS. 7–10, and will not be further described in detail. It is, however, noted that force application members 82 do have stop or locator lips 88 overlying cutters 86 on their inner sides.

Turning to FIGS. 14–16, there is shown an embodiment of the invention in which the foil cutting device is incorporated in a cork extracting apparatus or corkscrew. The form and operation of the cork extracting apparatus is generally that described in prior U.S. Pat. No. 4,291,597 and No. 4,377,096.

Briefly, the apparatus comprises two main parts, a cork engaging member—including a helical corkscrew proper 90 and a handle 92 rigidly affixed to the upper end of the corkscrew, and a holder or guide frame 94. The handle 92 is placed generally perpendicular to the axis of the corkscrew 90, so that the cork-engaging member 90, 92 as a whole is roughly T-shaped. As explained in the aforementioned prior U.S. patents, the corkscrew 90 includes a central helical body of a suitable metal, and an outer coating of a friction-reducing material such as polytetrafluoroethylene.

The holder or guide frame 94 includes an uppermost guide bushing 96 having a central longitudinal bore 98 in which the corkscrew 90 is removably disposed. The bore 98 is sized for a sliding fit on corkscrew 90, sothat the latter can move longitudinally and rotationally with respect to the guide frame 94. The holder 94 further comprises a pair of legs 100 which are diametrically opposed with respect to the central axis of corkscrew 90, which in use of the cork extractor, coincides with the axis of the bottle. The inner opposed sides of legs 100 have downwardly facing shoulders 100*c* intermediate their ends. These shoulders are designed to abut the upper end of a bottle neck when the cork extractor is used. The upper portions 100*a* of legs 100, generally above shoulders 100*c*, serve to space the guide bushing 96 from the top of the bottle to form a space for receipt of the cork as it emerges from the bottle neck. The lower portions 100*b* of legs 100 serve as gripping means with which the user can grasp the neck of the bottle.

As explained more fully in the aforementioned prior patents, the gripping means 100*b*, together with the shoulders 100*c*, serve as the bottle-engaging means of the apparatus, and keep the guide bushing 96 (and thereby the corkscrew 90) properly aligned with the bottle neck in use. The guide frame or holder 94 is made of a suitable plastic, such as suggested above for use in the frame 30, 32. As explained more fully in the prior patents, the legs 100 can be resiliently flexed so that the user can grasp various size bottle necks.

In use, the cork-engaging member 90, 92 is raised upwardly by its handle 92, and the holder 94 is emplaced on a bottle neck with the legs 100 extending vertically and disposed on opposite sides of the bottle neck, the shoulders 100*c* abutting the bottle top, and the gripping means 100*b* urged inwardly toward each other by the user's hand to actively grasp the bottle neck. The corkscrew 90 is extended downwardly through bore 98. The tip of the corkscrew 90 is started into the top of the cork, whereafter rotation of handle 92 causes the corkscrew 90 to be driven downwardly through the cork until the lower hub 92*a* of handle 92 comes into abutment with the upper end of guide bushing 96 thereby preventing further downward movement.

The corkscrew 90 is unusually long, as compared with more typical corkscrews, so that when the apparatus is in the last-mentioned position, the lower part of the corkscrew will extend substantially through the entire length of a typical cork, while the upper portion of the corkscrew will extend upwardly from the top of the cork into the cork-receiving space defined between spacers 100*a*, as shown. Then, by continuing to rotate handle 92 in a clockwise direction, the cork will be caused to climb threadedly up the corkscrew 90 and into the space between spacers 100*a*. Sharpened ridges 102 extending radially inwardly from the inner sides of spacers 100*a* engage the cork as it emerges from the bottle, preventing rotation thereof, and thereby facilitating complete removal, even of relatively old and fragile corks, and/or even if the friction-reducing coating of corkscrew 90 has become somewhat worn.

As improved in accord with the principles of the present invention, the guide frame 94 has extensions 104 integrally formed on opposed lateral edges of respective legs 100 and extending outwardly therefrom in a direction generally tangential to the locus of the bottle neck when the apparatus is in use in its cork extracting mode, as shown. The extensions 104 serve as the force application members when the device is used in a foil cutting mode, to be described more fully hereinafter.

Members 104 have opposed inner side walls 106. Each of the members 104 has a pair of rolling cutters 108 mounted therein so that they protrude inwardly beyond walls 106. Members 104 also have surfaces 110 extending inwardly beyond and generally overlying rollers 108 for abutment with the upper end of a bottle neck to aid the user in properly positioning the rollers 108.

It can be seen that, when the apparatus is disposed in its cork removal mode, i.e. with the legs 100 disposed vertically, members 104 and their rollers 108 will clear the bottle neck, and will not interfere with the cork removal operation as described above. However, prior to cork removal, the apparatus can be placed in a generally horizontal mode, with rollers 108 facing downwardly, in order to cut the foil which covers the bottle top. If desired, the cork-engaging member 92, 90 can be removed from the holder 94 during the foil cutting operation, although its presence will not prevent such foil cutting. In any event, when the device is placed in the foil cutting mode, the upper portions 100*a* of legs 100, together with the guide bushing 96 which interconnects them, will serve as a U-shaped connector for the members 104, and the same resilient flexibility of legs 100 which was operative in gripping the bottle neck for cork removal purposes will likewise provide the necessary resilient flexibility for the attached members 104 in the foil cutting operation. The use of the device in this mode is substantially the same as with the foregoing embodiments.

FIGS. 17 and 18 show another embodiment of the invention. In this embodiment, the frame of the device is formed of metal and includes a pair of force application members 120 symmetrically positioned on opposite sides of the axis A of the frame, and a generally U-shaped connector 122 connecting adjacent ends of the two force application members 120 and extending generally laterally with respect to axis A. Each of the force application members 120 includes an outermost skirt 124 and a flange or lip 126 extending inwardly from the upper extremity of the skirt 124. The cutting means are a set of four rolling cutters 128 mounted on lips 126 for rotation with respect to the frame.

The connector 122 includes a pair of opposed legs 130 joined distal force application members 120 by a base 132. Connector 122 has a pry type bottle cap opener incorporated therein. More specifically, a pair of tabs 134 extend laterally inwardly from the upper extremities of opposed legs 130. A third tab 136 extends inwardly from the underside of base 132. As shown in FIG. 18, tabs 134 can be placed on the top of a bottle cap 150, with tab 136 underlying the lower edge of the cap, and the cap can be pried off the bottle 152.

The action of the device of FIGS. 17 and 18 in its primary function, i.e. for cutting foil on a wine bottle neck, is essentially the same as that of the preceding embodiments. In particular, the lips or flanges 126 rest on top of the bottle, automatically positioning the cutters 128 a short distance below the bottle top, and the connector 122 allows the force application members 120 to be urged inwardly or outwardly from the unflexed position to engage the edges of rollers 128 with bottle necks of various diameters.

Referring finally to FIGS. 19 and 20, there is shown an inflexible or rigid form of the invention which is, nevertheless, capable of accommodating bottles of various sizes. In particular, the device of FIGS. 19 and 20 includes an uppermost knob-like handle 140 which rests in a generally horizontal position in use. Handle 140 extends across the upper end of a generally vertically oriented sleeve 142 rigidly affixed to handle 140. Sleeve 142 is generally frustoconical in configuration, as shown. A plurality of lengthwise slits 144, circumferentially spaced about sleeve 142, are formed by cutting and forcing inwardly flaps 146 of the metal material of which sleeve 142 is formed. The flaps 146 are bent inwardly so that they project into the interior of sleeve 142, and are sharpened to form cutting edges. Thus, the cutting surfaces 148 formed by these edges are radially spaced from the axis A of the device, aligned transversely of said axis, and circumferentially spread. There are six (6) such blades in the device as shown, so that the angular displacement between each cutting surface 148 and the two adjacent cutting surfaces is about 60°.

To use the device, it is simply lowered over the bottle neck 18 until a sufficiently small diameter portion of the device comes into abutment with the upper edge of the drip ring 18*a*. Then, still exerting a slight downward force, the user twists the device about 60° to sever the foil.

Accordingly, it is intended that the scope of the invention be limited only by the claims which follow.

What is claimed is:

1. A cutting device for cutting material covering wine bottle necks, comprising:

cutting means defining at least three cutting edges; and an integral frame having an axis transverse to said cutting edges, said frame carrying said cutting means and positioning said cutting means such that said cutting edges are radially spaced from said axis, aligned transversely of said axis, and circumferentially spread with the angular displacement between each cutting edge and each of the two adjacent cutting edges respectively less than 180°, whereby, upon rotation of said frame about said axis by an amount less than 180°, said cutting edges respectively define contiguous arcs of a common circle, said frame further being flexible by application of radial force to said frame at as few as two opposed points to move all three of said cutting edges to so define a plurality of such common circles of different diameters.

2. The apparatus of claim 1 wherein said cutting surfaces are circumferentially spaced apart, said device being adapted to define clearances between adjacent cutting surfaces, the circumferential spacing of said cutting edges being adequate to permit at least three-point engagement of said cutting means with bottle necks varying significantly in outer diameter.

3. The apparatus of claim 2 wherein said cutting edges are generally equally circumferentially spaced.

4. The apparatus of claim 1 wherein said frame comprises:

first and second force application members having opposed inner sides adapted for disposition on opposite sides of a wine bottle neck, each of said force application members carrying such cutting means on said inner side;

and resiliently flexible connector means interconnecting said force application members and having an unflexed position, wherein said force application members are diametrically spaced part by a distance greater than that required for engagement of said cutting means with the neck of a standard wine bottle, and from which said force application members may be urged inwardly toward each other.

5. The apparatus of claim 4 wherein said flexible connector means further permits said force application members to be urged outwardly away from each other from said unflexed position.

6. The apparatus of claim 1 wherein said diametrical distance between said lip formations, with said connector means in said unflexed position, is approximately 0.625 inch.

7. The apparatus of claim 5 wherein said radial distance between said axis and each of said cutting edges, with said connector means in said unflexed position, is approximately 0.6 inch.

8. The apparatus of claim 5 wherein each of said force application members has a lip formation extending inwardly beyond the respective cutting edges, and disposed above said cutting surfaces in use, for abutment with the top of such bottle.

9. The apparatus of claim 5 wherein each of said force application members has at least two such cutting edges circumferentially spaced apart, the angular displacement between each cutting edge and the two adjacent cutting edges being approximately 90°.

10. The apparatus of claim 5 wherein said connector means extends generally laterally from said force application members in use.

11. The apparatus of claim 5 wherein said cutting means are rollers mounted on said force-application members for rotation about generally vertical axes in use.

12. The apparatus of claim 11 wherein said force-application members are generally parallel, said connector means laterally connecting adjacent ends of said force-application members to form therewith a generally U-shaped body.

13. The apparatus of claim 12 wherein said connector means comprises two arms tapered toward each other from said force-application members to the base of said U-shaped body, said base being radiused.

14. The apparatus of claim 13 wherein said U-shaped body is comprised of a plastic material.

15. The apparatus of claim 14 wherein each of said force application members has a lip formation extending inwardly beyond the respective cutting edges, and disposed above said cutting edges in use, for abutment with the top of such bottle.

16. The apparatus of claim 5 wherein said force-application members are generally parallel, and said connector means comprises a first generally U-shaped member having two arms and a base, each of said arms adjoining a respective one of said force-application members.

17. The apparatus of claim 16 wherein said first U-shaped member extends generally laterally from said force application members in use.

18. The apparatus of claim 17 wherein said connector means further comprises a second generally U-shaped member adjoining said force-application members on the opposite side from said first U-shaped member and generally forming a mirror image thereof.

19. The apparatus of claim 17 wherein, when said cutting device is not in use as such, said arms may be disposed generally vertically, and are adapted, when so vertically disposed and urged toward each other, to grip such bottle neck, said arms having shoulders adapted to abut the upper end of such bottle when so gripped to space the base of said first U-shaped member from the top of such bottle, said base having a guide hole for guiding a corkscrew with respect to such bottle, and said cutting means being disposed to clear such bottle when said arms are so vertically disposed and gripping such bottle.

20. A cutting device for cutting material covering wine bottle necks, comprising:

cutting means defining at least three cutting edges; and a frame having an axis transverse to said cutting edges, said frame carrying said cutting means and positioning said cutting means such that said cutting edges are radially spaced from said axis, aligned transversely of said axis, and circumferentially spread with the angular displacement between each cutting edge and each of the two adjacent cutting edges respectively less than 180°, whereby upon rotation of said frame about said axis by an amount less than 180°, said cutting edges respectively define contiguous arcs of a common circle, said frame comprising first and second generally parallel force application members having opposed inner sides adapted for disposition on opposite sides of a wind bottle neck, one of said force application members carrying at least two such cutting means on its inner side, and the other of said force application members carrying at least one such cutting means on its inner side;

and resiliently flexible connector means laterally connecting adjacent ends of said force application members, and extending generally laterally therefrom to a point substantially distal said common circle, to form with said force application members a laterally oriented generally u-shaped body, said connector means having an unflexed position, wherein said force application members are diametrically spaced apart by a distance greater than that required for engagement of said cutting means with the neck of a standard wine bottle, and from which unflexed position said force application members may be flexed inwardly toward each other, about a flexure area of said connector means substantially distal said cutting means and said common circle, to permit said cutting edges to so define a plurality of such common circles of different diameters.

21. The apparatus of claim 20 wherein said U-shaped body has sufficient inherent resilience and flexibility to bias said force-application members to said unflexed position and permit such urging toward and away from each other.

22. The apparatus of claim 20 wherein said flexible connector further permits said force application members to be urged outwardly away from each other from said unflexed position.

23. The apparatus of claim 20 wherein said U-shaped body extends generally laterally from said force application members in use.

24. The apparatus of claim 23 wherein said connector means comprises two arms tapered toward each other from said force application members to the base of said u-shaped body, said base being radiused.

25. The apparatus of claim 24 wherein said u-shaped body is comprised of a plastic material.

26. The apparatus of claim 23 wherein each of said force application members has a lip formation extending inwardly beyond the respective cutting edges, and disposed above said cutting edges in use, for abutment with the top of such bottle.

27. The apparatus of claim 26 wherein said cutting means are rollers mounted on said force application members for rotation about generally vertical axes in use.

28. The apparatus of claim 12 wherein said cutting means define a bottle-receiving space, and the base of said U-shaped body is located distal said bottle-receiving space.

29. The apparatus of claim 28 wherein said cutting means define four such cutting edges, two of said cutting edges being disposed on each of said force application members, and the two cutting surfaces of each of said force application members being circumferentially spread.

30. The apparatus of claim 20 wherein said cutting means define four such cutting edges, two of said cutting edges being disposed on each of said force application members, and the two cutting edges of each of said force application members being circumferentially spread.

31. The apparatus of claim 30 wherein said cutting means comprise at least four rollers mounted on said force application members for rotation about generally vertical axes in use, and each defining a respective such cutting edge.

* * * * *